United States Patent [19]

Abbo

[11] 4,178,062

[45] Dec. 11, 1979

[54] MODULAR TELEPHONE CONNECTING BOX

[76] Inventor: Edward Abbo, 24 Woodhaven Dr., New City, N.Y. 10956

[21] Appl. No.: 928,886

[22] Filed: Jul. 28, 1978

[51] Int. Cl.[2] ..... H01R 33/76

[52] U.S. Cl. ..... 339/154 A; 179/1 PC; 339/192 R; 339/196 M

[58] Field of Search ..... 339/154 A, 156 R, 196 M, 339/196 R, 176 M, 198 J, 192 R, 154 R; 179/1 PC

[56] References Cited

U.S. PATENT DOCUMENTS

| | | | |
|---|---|---|---|
| 3,668,324 | 6/1972 | Firestone | 179/1 PC |
| 4,050,768 | 9/1977 | Gumb | 179/1 PC X |
| 4,071,696 | 1/1978 | Anderson | 179/1 PC |
| 4,088,384 | 5/1978 | Gumb | 339/156 R |

*Primary Examiner*—E. F. Desmond

*Attorney, Agent, or Firm*—Michael J. Striker

[57] ABSTRACT

The modular telephone box comprises a flanged housing and within the housing a multi-pin telephone receptacle having contact openings located on the top surface of the housing; a second telephone connecting receptacle is secured to one side of the housing; a contact plate is mounted in the housing parallel to its top surface and includes bolt nuts embedded therein, the bolt nuts forming a configuration corresponding to that of the openings of the first receptacle, each nut being connected to a corresponding contact in the first and second receptacles; a contact plate is adapted to support either flat contact springs for contacting a telephone terminal block or, alternatively, contact pins having threaded end portions screwed into the bolt nuts and projecting above the bottom edge of the housing to form a telephone connecting plug matching contact openings of the first receptacle of an other modular connecting box.

5 Claims, 9 Drawing Figures

MODULAR TELEPHONE CONNECTING BOX

BACKGROUND OF THE INVENTION

This invention relates generally to a connector for a telephone apparatus and more specifically, it relates to a modular connecting unit capable of connecting several telephones or telephone accessories each with different plugs to a single terminal block or outlet.

Various telephone connecting units of this type have been designed to provide rapid connection and disconnection of the cord of a telephone apparatus to a wall terminal. The disadvantage of such known telephone connectors and/or connector adaptors is in the fact that different structures are used for the telephone receptacle and for the telephone plug of the connecting assembly. These differences in structure and configuration not only increase the manufacturing cost but also result in rather complicated installations by the user, especially when more telephone accessories having different plugs are used.

SUMMARY OF THE INVENTION

It is therefore the primary object of this invention to avoid the above-mentioned disadvantages of conventional telephone connectors. In particular an object of this invention is to provide a modular telephone connecting unit that is readily convertible from a receptacle into a plug and vice versa.

Another object of this invention is to provide a telephone connecting unit capable of connecting several telephones or telephone accessories each having different plugs to a single telephone terminal outlet.

Still another object of this invention is to provide a telephone connecting unit that can be adjusted to various accessories and connect it to a wall terminal without any wiring.

In keeping with these objects and with others which will become apparent hereafter, one feature of the invention resides, in a modular telephone connecting box, in a combination of a housing defining a top surface, side walls and an open bottom, a first telephone receptacle provided inside the housing near the top portion thereof and having a plurality of contact openings passing through the top surface of the housing, a second telephone receptable mounted inside the housing and accessible through an opening in the side wall thereof, a contact plate secured within the housing opposite the first receptacle and including a plurality of bolt nuts embedded therein, each bolt nut being electrically connected at the sides of the plate facing the first receptacle to an assigned contact opening of the first receptacle and to an assigned contact of the second receptacle, and a plurality of contacting elements projecting toward the open bottom of the housing and each being screwed in an assigned bolt nut.

In the case when the modular box of this invention is employed as a part matching the contact openings of the first receptacle in a second modular box of this invention, the contacting elements are in the form of contact pins provided at one end with threads to replace the short bolts fastening the flat springs to the plate.

Preferably, the side wall of the housing opposite to the second receptacle is provided with an aperture for receiving a telephone cord, the conductors of which are connectable to the bolts nuts in the contact plate.

The contact openings in the first and second receptacles are preferably provided with contact springs in the form of two spiral springs inserted laterally one into the other.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
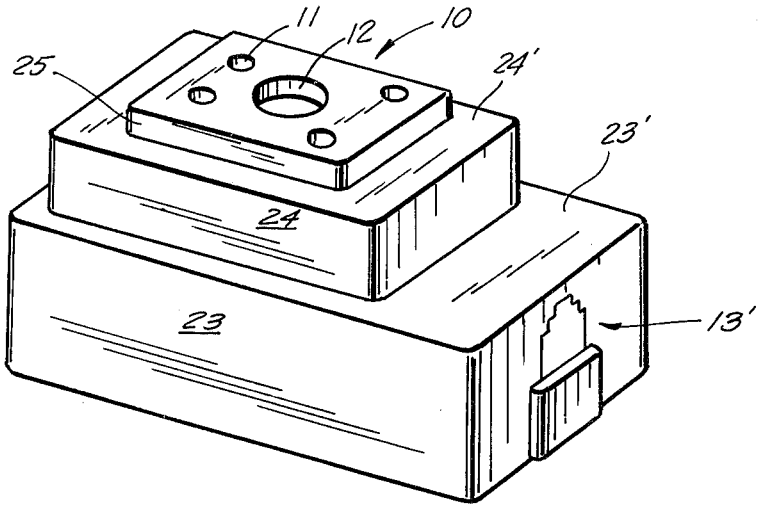
FIG. 1 is a perspective view of the modular connecting box of this invention in the form of a wall socket.
Figure 2:
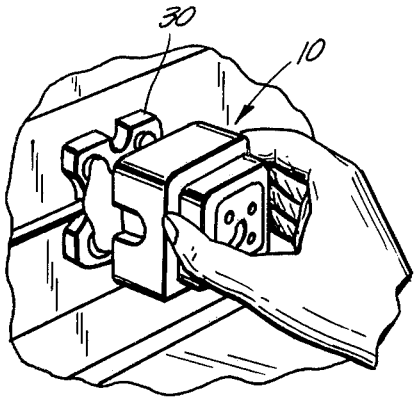
FIG. 2 illustrates the installation of the box of FIG. 1 to a standard telephone wall terminal.
Figure 8:
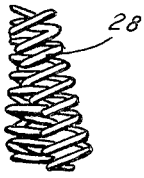
FIG. 8 shows a spring contact used for cooperation with pins of FIG. 6*b*.

FIGS. 1 and 2 show the basic modular connecting box 10 for connecting telephones or one telephone and accessory each with different plugs, to an outlet 30. The box includes a housing 10 made of an insulating, preferably plastic material and having a configuration of three superposed rectangular prisms 23, 24 and 25 of receding cross-sections. As can be seen from FIGS. 3 and 4, the lowermost prism 23 defines a flange 23' between its top surface and the side walls of the superposed intermediate rectangular prism 24 and similar flange 24' results on the top surface of the prism 24. The top surface of the uppermost prism 25 of the housing 10 is provided with an opening 12 for receiving a mounting bolt when the modular box 10 is used as a wall socket connectable to a standard telephone wall terminal block 30 as indicated in FIG. 2. Furthermore, the top surface of the uppermost rectangular prism 25 has four contact passages 11 each containing a contact spring 28 illustrated in FIG. 8. One side of the prism 23 of housing 10 is provided with an opening 13' for receiving a plug (not shown) of a standard telephone connector whereas the receptacle 13 of the standard telephone connector is mounted inside the housing 10 on a partition 21 connecting inside walls of the lowermost prism 23. As can be seen also from FIG. 4 the contacts of the standard telephone socket 13 are connected by means of conductors 20 to terminal eyelets 19 which respectively surround the lower edges of passages 11 inside the uppermost prism 25. The inner top surface of the prism 25 is extended downwardly to project into the interior of the intermediate prism 24 up to the level of the upper surface of the lowermost prism 23 and the passages 11 pass throughout the resulting extension 26.

Figure 3:
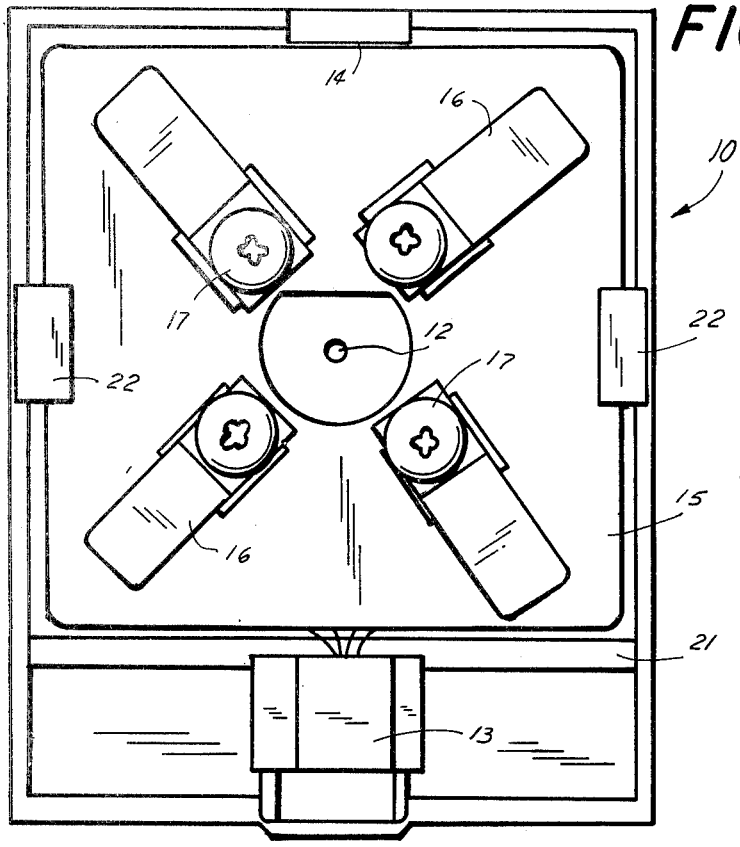
FIG. 3 is a bottom view of the box of FIG. 1.
Figure 5:
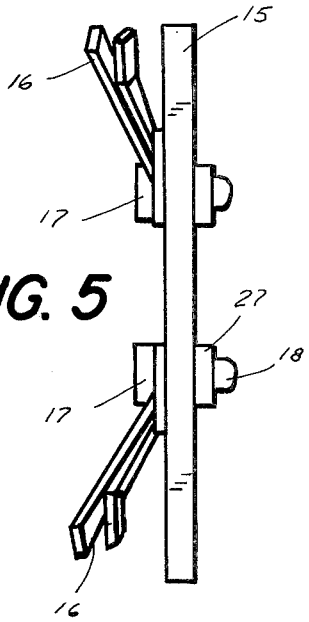
FIG. 5 is a side view of the contact plate in the box of this invention when used as connector socket.
Figure 6A:
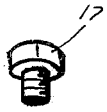
FIG. 6*a* shows a bolt for fastening flat contact springs to the contact plate of FIG. 5.
Figure 4:
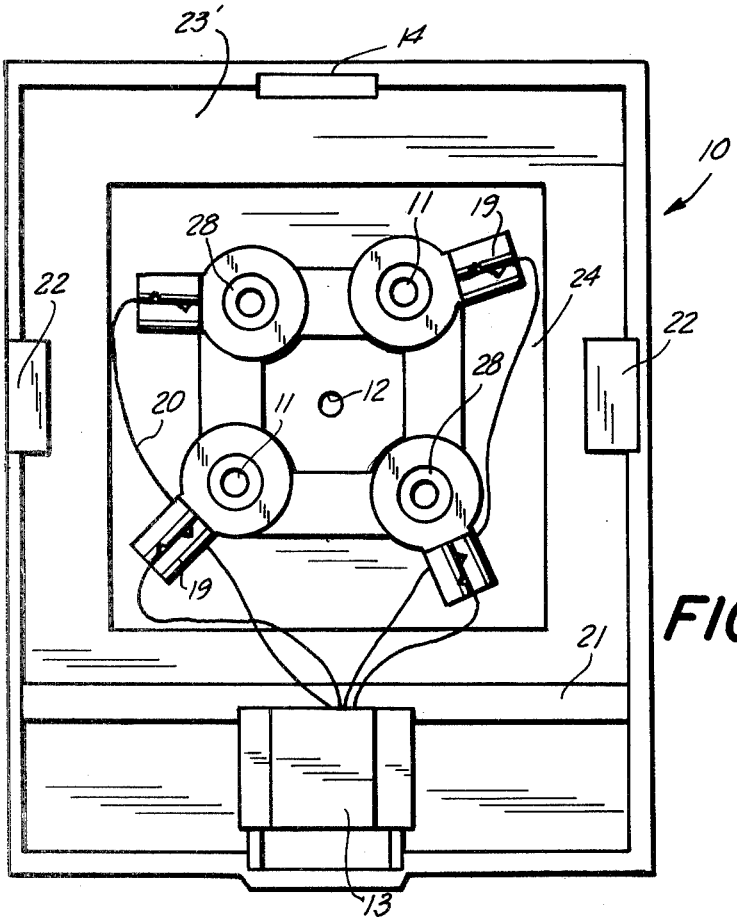
FIG. 4 is a view similar to that of FIG. 3 but without the contact plate.
Figure 6B:
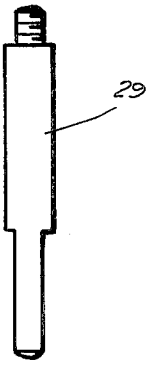
FIG. 6*b* shows a contact pin replacing the short bolt of FIG. 6*a* when the box of this invention is converted into a connector plug.

As illustrated in FIG. 3, a contact plate 15 shown in greater detail in FIG. 5, is supported on the inner surface of flange 23' between lower prism 23 and intermediate prism 24, and is held in position by means of catches 22 integrally formed on the opposite inner side walls of the housing 10. Four bolt nuts 27 (FIG. 5) are embedded in the plate 15 each facing an assigned passage 11 in the housing 10. Plate 15 is made of an insulating material whereas the bolt nuts 27 are made of metal and are provided at one side with internally threaded holes for receiving mounting bolts 17 or alternatively externally threaded end portions of contact pins 29 as it will be explained below. The other side of bolt nuts 27 is provided with projections 18 insertable through eyelets 19 into corresponding passages 11 to contact springs 28 located in those passages.

Figure 7:
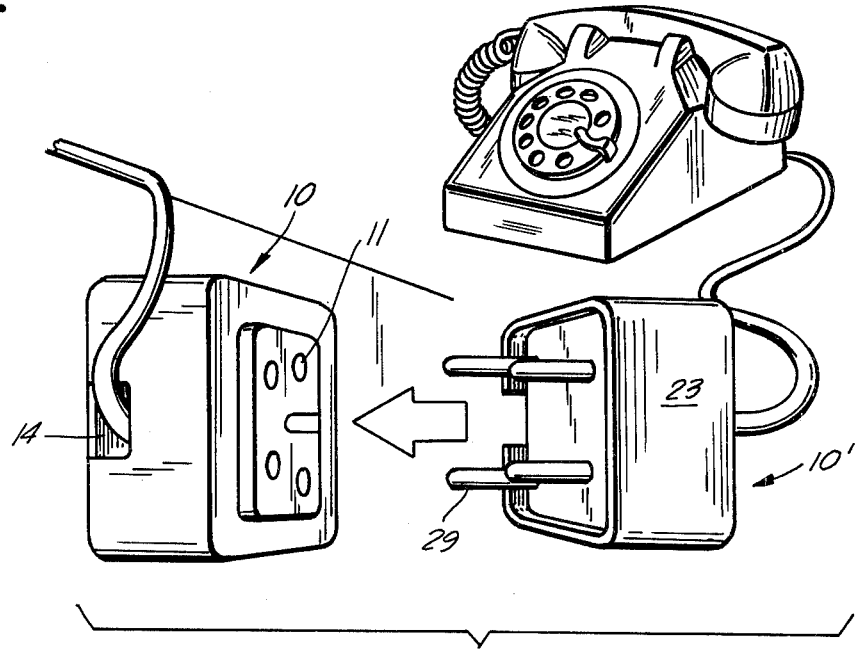
FIG. 7 illustrates in a perspective view a universal telephone connector formed of two modified boxes of this invention.

According to this invention the modular box 10 is designed both for the application as a telephone wall socket for use in connection with a standard telephone block terminal 30 (FIG. 2) and as a telephone plug 10' (FIG. 7) having pins 29 insertable into matching passages 11 of another modular box 10 attached to the wall.

In the first case, when the box is to be used as a universal telephone socket the contact plate 18 supports flat springs 16 secured at one end thereof to the bolts nuts 27 by means of short bolts 17. Free ends of the flat springs 16 are bent away from the plate 15 so as to abut upon corresponding contact surfaces on the terminal block 30. Upon mounting the modular unit 10 to the terminal block 30 by a screw passing through the top opening 12, the modular box 10 serves, as mentioned above, as an adaptor for receiving a standard telephone plug 13' or through another opening 14 in the housing 10, to accommodate a cord of a telephone apparatus whereby individual conductors for the cord are connected to respective bolt nuts on the contact plate 15.

The contact passages 11 on the upper surface of the prism 25 are useable as an auxiliary connector socket in cooperation with another modular connecting box 10'. To convert the socket box of FIG. 3 into a plug box 10' of FIG. 7 it is necessary only to unscrew the short bolts 17 from the contact plate 15 and replace them by the contact pins 29. The spacing pattern of the bolt nuts 27 embedded in the plate 15 matches the spring pattern of contact passages 11 and in this manner the conversion is made without any wiring or alternation of the modular box.

While the invention has been illustrated and described as embodied in a modular telephone connecting box for use with two telephones or telephone accessories, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the specific aspects of this invention.

What is claimed as new and desired to be protected by Letters Patent is set forth in the appended claims:

1. A modular telephone connecting box, comprising a housing having a top surface, side walls and an open bottom; a first telephone connecting receptacle provided inside said housing in operative proximity to the top portion thereof and having a plurality of contact passages passing through said top surface; a second telephone connecting receptacle mounted inside said housing in operative proximity to one side wall thereof and having a plurality of contacts, said one side wall defining an opening opposite to said second receptacle for receiving a telephone plug matching said second receptacle; a contact plate secured inside said housing opposite to said first receptacle and parallel to said top surface; a plurality of bolt nuts embedded in said contact plate and being electrically connected to corresponding contact passages of said first receptacle, said contacts of said second receptacle being connected to said bolt nuts, respectively; and a plurality of contacting elements projecting toward said open bottom and each being screwable into an assigned bolt nut.

2. A modular box as defined in claim 1, wherein said contacting elements are flat springs adapted for contacting a standard telephone terminal box, each spring being fastened to an assigned bolt nut by a short bolt.

3. A modular box as defined in claim 1, wherein said contacting elements are contact pins having threaded end portions adapted for being screwed into said bolt nuts, said pins projecting above the bottom edge of said housing to provide a telephone connecting part matching the first telephone connecting receptacle in another modular connecting box.

4. A modular box as defined in claim 1, wherein another side wall of said housing is provided with an opening for receiving a telephone cord.

5. A modular box as defined in claim 1, wherein said first receptacle includes a plurality of spiral contact springs disposed in said contact opening and connected to said bolt nut.

* * * * *